United States Patent [19]

Yacovella

[11] Patent Number: 4,656,065

[45] Date of Patent: Apr. 7, 1987

[54] BARK CAMOUFLAGE CLOTH AND OUTER GARMENTS

[75] Inventor: Thomas R. Yacovella, Utica, N.Y.

[73] Assignee: Utica Duxbak Corporation, Utica, N.Y.

[21] Appl. No.: 820,412

[22] Filed: Jan. 17, 1986

[51] Int. Cl.[4] ..... F41H 3/00

[52] U.S. Cl. ..... 428/17; 2/1; 428/151; 428/919

[58] Field of Search ..... 428/151, 904.4, 919, 428/17, 18; 2/1

[56] References Cited

U.S. PATENT DOCUMENTS

| | | | |
|---|---|---|---|
| 1,139,642 | 5/1915 | Cox | 428/919 X |
| 1,291,809 | 1/1919 | Ekker | 428/919 X |
| 2,352,810 | 7/1944 | Swain | 106/253 X |
| 3,811,915 | 5/1974 | Burrell et al. | 428/143 |
| 4,320,163 | 3/1982 | Schwartz | 428/159 X |
| 4,409,275 | 10/1983 | Samowich | 428/904.4 X |

*Primary Examiner*—Henry F. Epstein
*Attorney, Agent, or Firm*—Bruns and Wall

[57] ABSTRACT

A bark camouflage cloth mimics the rough bark of a tree. The camouflage pattern on the cloth consists basically of rough, highly elongated vertical ribs of a first light or countershaded earth tone, vertical channels of a second, darker earth tone, and black vertical shadow edge markings along one side edge of each of the ribs. Islands of a third color, e.g., a greenish hue, are interspersed among the vertical ribs. The pattern of vertical shadow edge markings changes from left to right across the pattern to create the illusion of curvature of a tree trunk.

13 Claims, 3 Drawing Figures

BARK CAMOUFLAGE CLOTH AND OUTER GARMENTS

BACKGROUND OF THE INVENTION

This invention relates to camouflage cloth material and to camouflage garments for hunting and the like made of such material. The invention is more particularly directed to a tree bark camouflage which combines the principles of mimicry, disruptive patterning, shading, and countershading so that the wearer of the garment blends in against a background of tree bark.

Traditional camouflage material, since World War II, has been formed in patterns of earth-colored splotches on a lighter background, or darker, green-dominated, leafy patterned camouflage. More recently, imitation bark patterns have been introduced, and these latter patterns have retained much of the splotchiness of the traditional camouflage patterns. However, these previously proposed camouflage materials have not been ideal for hunting in softwood or hardwood forests, because their more-or-less traditional camouflage patterns have not mimicked real tree bark sufficiently well, and do not cause the wearer to resemble or blend with the trunks of surrounding trees.

Many of the bark camouflage patterns sold today are almost photographic and are designed to look like a particular type of tree. Consequently, this type of camouflage works only if the hunter is standing among trees of that particular kind. Other types of bark camouflage are characterized by groupings of lighter tones, which can be easily spotted by game. Still others use small or closely connected patterns which can be too tight, and lose definition, becoming discernible masses of color at a distance.

OBJECTS AND SUMMARY OF THE INVENTION

Accordingly, it is an object of this invention to provide camouflage material, and camouflage garments made of such material, that blends in well with a tree bark environment, and which incorporates optimal features of camouflage, to wit, mimicry of actual tree bark, disruptive patterning, shading, and countershading.

It has been determined that the principles of mimicry, disruptive patterning, and shading and countershading are the most significant ingredients of superior camouflaging.

Mimicry is the most apparent feature, and means in simplest terms that the camouflage material looks like something else, in this case, like the rough bark of a tree. In other words, the tree bark camouflage pattern on the cloth and the garments of this invention has an unmistakable bark pattern which enables a hunter or other wearer to virtually disappear while sitting or standing in front of a rough bark tree.

While mimicry is important, simply looking like the background is not always sufficient. Often, the underlying form can still give the hunter away. For that reason, the principle of disruptive patterning is also employed in the pattern of the camouflage cloth of this invention. For disruptive patterning, continuous bands of color break up the form of the garment or the hunter wearing it, to further enable the hunter to blend in with the environment. This patterning breaks up the form and confuses the eye of an observer. More specifically, in the tree bark camouflage pattern of the cloth and the garment of this invention, there are continuous ribs of tree bark extending vertically for the height of the cloth or of the garment made of the cloth, and there are also patches of green against darker browns and blacks in the background. The latter breaks up the continuous bark pattern, simulating, e.g., algae, moss, or lichens, or many of the other greens of the forest.

The principle of shading and countershading achieve even greater realism by including strong, vertical black patterns which act as shadows and gives a three dimensional appearance to the lighter bark ribs. This avoids the appearance of flatness or sameness which has long plagued traditional camouflage clothing. Shading and countershading also creates an illusion of diminshed size contrasting against the lighter or countershading brown tones. The black shadow feature abuts the lighter brown or earth color ribs of bark coloration, changing from the left side to the right side of the bark ribs from one side of the camouflage garment to the other, creating an illusion of the roundness of a hardwood or softwood tree trunk.

The bark camouflage pattern of the cloth and of the garment of this invention has been found to work well with many different kinds of trees, both softwoods and hardwoods, and its bold, three-dimensional affect works well in all types of cover.

More particularly, in keeping with the objects of this invention, the camouflage cloth or other material of this invention is configured to mimic the rough bark of a tree. The cloth has a camouflage pattern consisting basically of rough, highly elongated vertical ribs of a first color, a plurality of vertical countershade channels of a second color interspersed between the vertical bars of the first color, and black vertical shadow edge markings along one side edge of each of the bars of the first color, with islands of a third color being interspersed among the vertical ribs. By black is meant either jet black or a very dark color to simulate shadows. At least some of the vertical ribs extend uninterrupted over the vertical extent of the vertical cloth. The first and second colors are muted brownish or earth tone shades, and the islands of the third color are of a predominantly greenish hue. The pattern is divided into alternate panels, arranged side-by-side horizontally on the cloth. The shadow edge markings extend along the right edge only of the vertical ribs on the left panels, and along the left edge only of the vertical ribs in the right panels. This creates the illusion of shadows that are characteristic of tree trunk curvature. Other features include substantially horizontal notches in the ribs, filled in with the black shadow markings, to further enhance the three-dimensional effect.

The above and many other objects, features, and advantages of this invention will be more fully understood from the ensuing detailed description of the preferred embodiment of this invention when considered in connection with the accompanying drawing.

DETAILED DESCRIPTION OF THE PREFERRED EMBODIMENT

Figure 1:
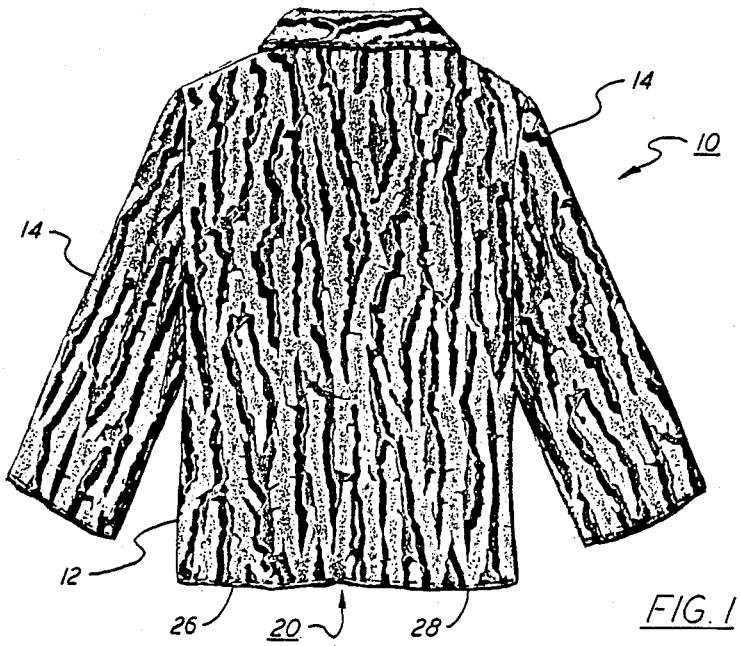
FIG. 1 is a rear view of a blouse or jacket made of camouflage cloth according to one embodiment of this invention.

With reference to the drawing, and initially to FIG. 1 thereof, an outer garment 10, here a jacket, is shown to have a torso portion 12 and sleeves 14, both formed of the vertical tree bark camouflage cloth 20 of this invention. Trousers, gloves, head coverings, etc. of similar pattern, while not specifically shown, would be made of the same cloth 20.

Figure 2:
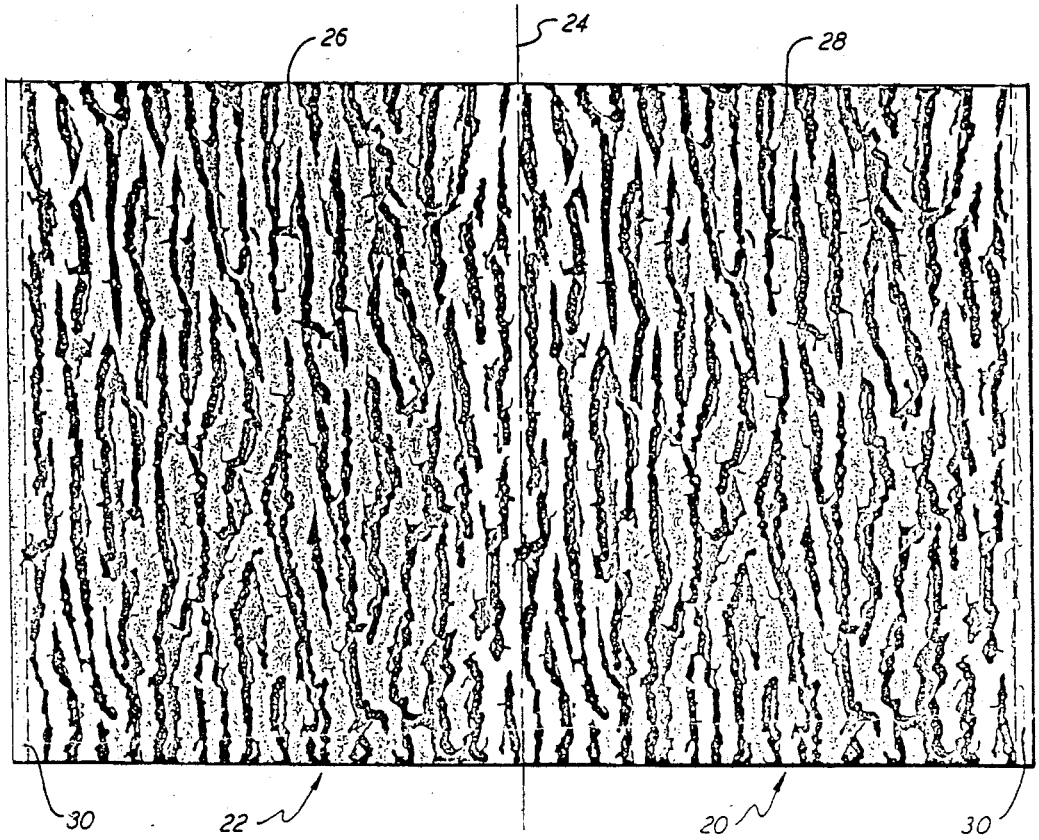
FIG. 2 is a view of camouflage fabric printed with the tree bark camouflage pattern of the embodiment of this invention.

The camouflage pattern, as shown in FIG. 2, is printed on a continuous roll or bolt 22 of the cloth 20. The camouflage pattern printed on the cloth 20 reverses its shadow effect along a pattern reversal vertical plane 24 shown in phanton outline. This plane 24 divides the part of the cloth shown into a left panel 26 and a right panel 28. However, it is understood that the pattern includes a repetition of these panels 26, 28 side-by-side along the cloth. Selvages 30 appear at the side edges of the cloth 20, and comprise the borders. The selvages 30 are generally not visible in the finished garment 10.

The cloth is considered vertically oriented as shown in FIG. 2, with elongated ribs of a first color and channels of a second related color running generally vertically across the pattern on the cloth 20.

Figure 3:
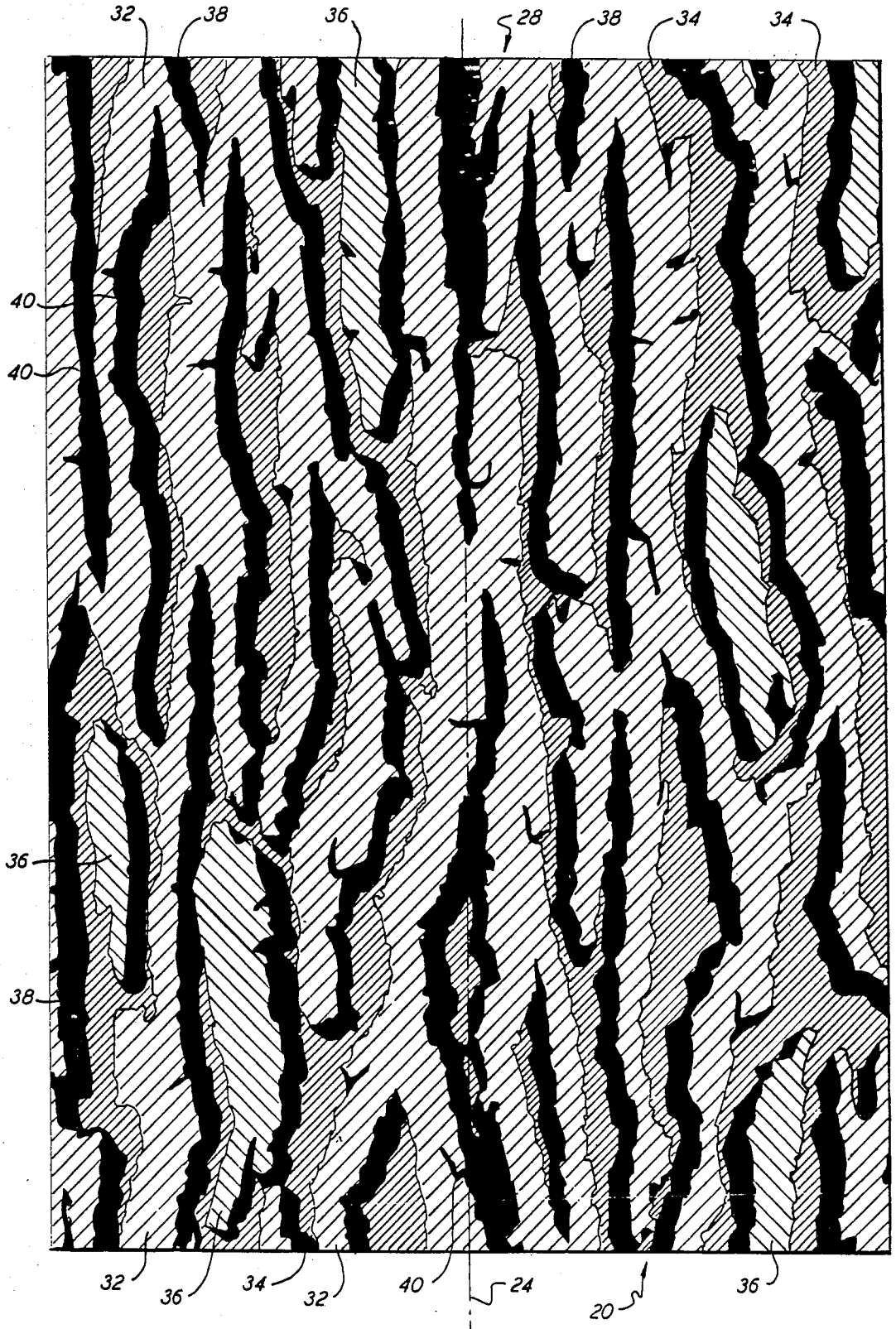
FIG. 3 is a detail view of a portion of the cloth of FIG. 2, showing details of the pattern.

As shown in detail in FIG. 3, the vertical ribs 32 are colored a light brown or other muted earth color, such as mauve, taupe, etc., and represent the raised part of the tree bark which serve as a countershading. The channels 34 are colored with a second, darker brownish or earthy tone and represent recesses showing the body of the tree trunk. The ribs 32 extend substantially across the camouflage pattern, while the channels 34 are discontinuous to a minor extent, just enough to break up the vertical bars. Several islands 36 of a predominantly greenish hue, representing moss, lichens, or the like, break up the pattern of the brown vertical ribs and channels, thus functioning as disruptive patterning. Black vertical shadow edge markings 38 are disposed along one side edge of each of the ribs 32, and also at one side edge of each of the islands 36, to create a three-dimension illusion. These markings 38 are provided along one side only of the ribs 32 and the islands 36, to wit, on the right edge of the ribs 32 and islands 36 in the left panel 26 (i.e., to the left of the center line 24) and on the left side edges of the ribs 32 and islands 36 in the right panel 28 (i.e., to the right of the center line 24). The vertical ribs 32 and the islands 36 have meandering bark-like vertical side edges, and the associated shadow markings 38 have one edge abutting the meandering side edge of the ribs and islands, and another edge generally following the meander of the edge of the associated rib or island, but spaced from it. The ribs 32 and the islands 36 also have generally horizontal notches 40 along their vertical edges, and the black shadow edge markings fill in these notches 40.

Returning to FIG. 1, it is seen that the position of the pattern reversal plane 24 is about at the center of the torso part 12 of the outer jacket 10. While the back only is shown of this jacket 10, it should be understood that the front would be patterned similarly. Thus, as shown, the left half of the jacket's torso part 12 is formed from the left panel 26, and the right part thereof from the right panel 28. The shadow pattern formed by the shadow markings 38 creates the illusion of roundness, as the shadow position changes from left to right, mimicking the horizontal curvature of a trunk.

The legs of the trousers would be treated similarly, with the pattern reversal line 24 being about at the leg seam plane, for example.

With a camouflage suit made of the camouflage cloth of this invention, a person standing in a cover of trees, either hardwood or softwood, would not be readily visible, and would blend in with the natural tree bark of his or her surroundings. Also, if a prone position is required, the hunter's camouflage clothing will give him the appearance of a log or fallen tree trunk.

While the invention has been described hereinabove with respect to a preferred embodiment, it should be understood that the invention is not limited to that precise embodiment, and that many modifications and variations thereof would present themselves to those skilled in the art without departure from the scope and spirit of this invention, as defined in the appended claims.

I claim:

1. Camouflage material configured to mimic the rough bark of a tree or trees, the material having thereon a camouflage pattern that includes rough appearing, highly elongated vertical ribs of a first color positioned on either side of a centrally disposed vertical plane a plurality of vertical channels of a second color which is darker than the first color interspersed between said vertical ribs, dark vertical shadow edge markings along one side edge of each of said vertical ribs, said shadow edge markings being along the one side edge of each rib that faces the vertical plane whereby the ribs give the appearance of bark extending about a tree trunk.

2. Camouflage material as in claim 1 wherein said dark shadow edge markings are provided along one edge of islands that face the central plane and said islands are of a third color.

3. Camouflage material as in claim 1 wherein at least some of said vertical ribs of said first color extend uninterrupted across the vertical extent of the pattern.

4. Camouflage material as in claim 1 wherein said first and second colors are respectively lighter and darker muted brownish shades, and said third color is green.

5. Camouflage material as in claim 1 wherein said pattern is divided into alternate panels arranged side-by-side horizontally on said material, with said shadow edge markings extending along the right edge of the vertical ribs in alternate panels, and along the left edge of the vertical ribs in the remaining panels.

6. Camouflage material as in claim 1 wherein said vertical ribs have irregular notches along their vertical edges, with said vertical shadow edge markings entering said notches.

7. Camouflage material as in claim 1 wherein said vertical ribs have irregular meandering bark-like, vertical side edges, and the associated shadow markings have one edge abutting the meandering side edge and another edge generally following the meander of the edge of the associated vertical rib, but spaced therefrom.

8. A camouflage garment which serves to camouflage the wearer thereof by blending in with the bark of trees, the garment having a main body part covering generally the torso of the wearer, and being made of a camouflage cloth patterned to mimic the rough bark of a tree, the pattern including a plurality of rough, highly elongated vertical ribs of a first color positioned on either side of a centrally disposed vertical plane, a plurality of vertical channels of a second color which is darker than the first color interspersed between said vertical ribs, dark vertical shadow edge markings along one side edge only of said vertical ribs, said shadow edge marking being along one vertical side edge of each rib that faces the vertical plane whereby the ribs give the apperance of bark extending about a tree trunk, and islands of a third color interspersed among the vertical ribs that also contain dark shadow edge markings along one vertical edge thereof tha face said vertical plane.

9. The camouflage outer garment of claim 8 wherein at least some of the vertical ribs extend uninterrupted for the vertical length of said main body part of the garment.

10. The camouflage outer garment of claim 8 wherein said vertical ribs have an irregular bark-like shape, and said shadow edge markings have shapes conforming to the associated side edges of the respective vertical ribs.

11. The camouflage outer garment of claim 8 in which said first color is a muted earth color and said second color is another muted earth color darker than said first color.

12. The camouflage outer garment of claim 11 in which said third color is of predominantly green hue.

13. The camouflage outer garment of claim 8 wherein said vertical ribs have irregular horizontal notches along their side edges, with said shadow edge markings entering said notches.

* * * * *